US005640981A

United States Patent [19]

Niemela et al.

[11] Patent Number: 5,640,981

[45] Date of Patent: Jun. 24, 1997

[54] PARTS WASHER

[75] Inventors: Cal G. Niemela; Nels A. Niemela, both of Chassell, Mich.

[73] Assignee: Cuda Corporation, Calumet, Mich.

[21] Appl. No.: 432,294

[22] Filed: May 1, 1995

[51] Int. Cl.[6] ..... B08B 3/02

[52] U.S. Cl. ..... 134/114; 49/40; 134/200

[58] Field of Search ..... 134/114, 143, 134/153, 158, 200; 312/305, 307, 326, 329; 49/40, 41, 425

[56] References Cited

U.S. PATENT DOCUMENTS

| | | | |
|---|---|---|---|
| 1,115,994 | 11/1914 | Williams . | |
| 1,406,368 | 2/1922 | Gallagher | 312/307 X |
| 1,502,131 | 7/1924 | Vaudreuil | 134/200 X |
| 1,680,962 | 8/1928 | Voshardt | 134/114 X |
| 1,687,617 | 10/1928 | Jewell | 134/114 |
| 2,385,150 | 9/1945 | Miller . | |
| 2,573,008 | 10/1951 | Gorden . | |
| 2,627,863 | 2/1953 | Cavicchhioli . | |
| 2,643,659 | 6/1953 | Auten . | |
| 2,651,311 | 9/1953 | Rule . | |
| 2,687,137 | 8/1954 | Kramer et al. . | |
| 2,704,082 | 3/1955 | Jackson | 134/200 X |
| 2,940,458 | 6/1960 | Speckman . | |
| 3,060,946 | 10/1962 | Lantz | 134/153 X |
| 3,076,468 | 2/1963 | Belt . | |
| 3,117,583 | 1/1964 | Hearn et al. . | |
| 3,133,547 | 5/1964 | Dannenmann et al. . | |
| 3,394,718 | 7/1968 | Wallgren et al. | 134/153 X |
| 3,416,544 | 12/1968 | Paiva . | |

(List continued on next page.)

FOREIGN PATENT DOCUMENTS

| | | | |
|---|---|---|---|
| 1907295 | 6/1970 | Germany . | |
| 145929 | 3/1931 | Switzerland . | |
| 149953 | 12/1931 | Switzerland | 134/114 |
| 437252 | 5/1935 | United Kingdom . | |
| 1080168 | 8/1967 | United Kingdom . | |
| 1467369 | 3/1977 | United Kingdom | 49/41 |
| 1605046 | 12/1981 | United Kingdom . | |

OTHER PUBLICATIONS

Exhibit A is a product brochure entitled "Kansas Instruments D–30S Spraycab," published by Kansas Instruments, Council Grove, Kansas, publication date Jun. 1992, disclosing an automatic high pressure spray cleaning cabinet.

Exhibit B is a product brochure entitled "Kansas Instruments Model SC & SKS 2233 Spraycab Systems," published by Kansas Instruments, Council Grove, Kansas, publication date Feb. 1992, disclosing an automatic high pressure spray cleaning cabinet.

Exhibit C is a product brochure entitled "Kansas Instruments D–54 Spraycab," published by Kansas Instruments, Council Grove, Kansas, publication date Jun. 1992, disclosing an automatic high pressure spray cleaning cabinet.

Exhibit D is a product brochure entitled "Jet Washing—The Purifiers," published by Better Engineering Mfg., Inc., Baltimore, Maryland, publication date 1992, disclosing an automatic high pressure spray cleaning cabinet.

(List continued on next page.)

*Primary Examiner*—Philip R. Coe

*Attorney, Agent, or Firm*—Van Dyke, Gardner, Linn & Burkhart, LLP

[57] ABSTRACT

Parts washers are provided including a collection tank, a funnel-bottomed wash cabinet supported on the collection tank, and a cover pivotally supported on the wash cabinet for closing an access opening to the wash cabinet. A screen is mounted in a narrowed section at the bottom of the wash cabinet and is conveniently removable from a front of the wash cabinet. An oil skimmer is pivotally mounted to the tank to allow access to the sump pump without disassembly of the parts washer. In one embodiment, a water seal is provided under a front edge of a door on the wash cabinet. In another embodiment, a rough metal band extends around a turntable and a drive wheel, the rough metal band having prick marks along its length to reduce slippage on the drive wheel.

16 Claims, 11 Drawing Sheets

U.S. PATENT DOCUMENTS

| | | |
|---|---|---|
| 3,460,550 | 8/1969 | Zanussi . |
| 3,580,261 | 5/1971 | Key . |
| 3,624,750 | 11/1971 | Peterson . |
| 3,776,246 | 12/1973 | Ballard . |
| 4,052,227 | 10/1977 | Delo et al. . |
| 4,056,260 | 11/1977 | David . |
| 4,143,669 | 3/1979 | Minkin . |
| 4,170,240 | 10/1979 | Gentry . |
| 4,213,475 | 7/1980 | Minkin . |
| 4,217,920 | 8/1980 | Ballard . |
| 4,326,556 | 4/1982 | Deutsch et al. . |
| 4,440,185 | 4/1984 | Wiltse . |
| 4,529,032 | 7/1985 | Molitor . |
| 4,651,762 | 3/1987 | Bowden . |
| 4,739,782 | 4/1988 | Nourie . |
| 4,741,351 | 5/1988 | Minkin . |
| 4,744,379 | 5/1988 | Goettel . |
| 4,842,001 | 6/1989 | O'Leary . |
| 4,998,550 | 3/1991 | Archambault . |
| 5,107,876 | 4/1992 | Ozyjiwsky . |
| 5,129,411 | 7/1992 | Lagerstrand . |
| 5,154,200 | 10/1992 | Hall, Sr. . |
| 5,165,431 | 11/1992 | Tromblee et al. . |
| 5,213,117 | 5/1993 | Yamamoto . |
| 5,232,299 | 8/1993 | Hiss . |
| 5,265,633 | 11/1993 | Knowlton . |
| 5,277,208 | 1/1994 | Mansur . |
| 5,305,769 | 4/1994 | Jung . |
| 5,322,078 | 6/1994 | Tuttle . |

OTHER PUBLICATIONS

Exhibit E is a product brochure entitled "no Solvents Aqueous Parts Cleaning—Clam—Mini–Wash," published by G.M.F. Industries, Inc., Lakeland, Florida, publication date prior to May 1, 1994, disclosing an automatic high pressure spray cleaning cabinet.

Exhibit F is a product brochure entitled "HydroBlast," published by Hydro–Blast, Inc., Vancouver, Washington, publication date 1994, including drawings Copyright 1993, disclosing an automatic high pressure spray cleaning cabinet.

Exhibit G is a product brochure entitled "Hotsy Tubs," published by The Hotsy Corporation, Englewood, Colorado, publication date Feb. 1993, disclosing an automatic high pressure spray cleaning cabinet.

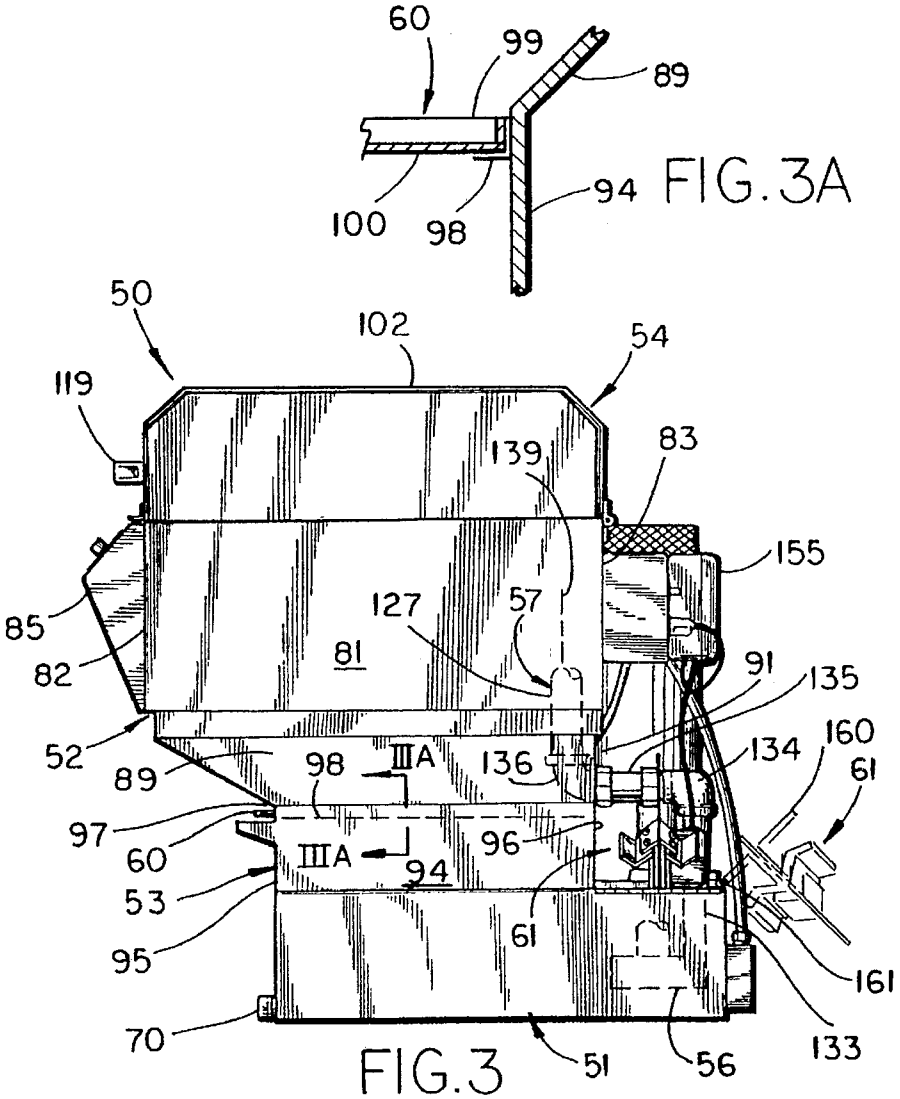
FIG. 3A
FIG. 3
89
94
99
98
60
100
54
83
155
91
135
134
160
61
161
133
56
51
139
57
136
96
61
102
127
81
IIIA
IIIA
94
98
50
119
85
82
52
89
97
60
53
95
70
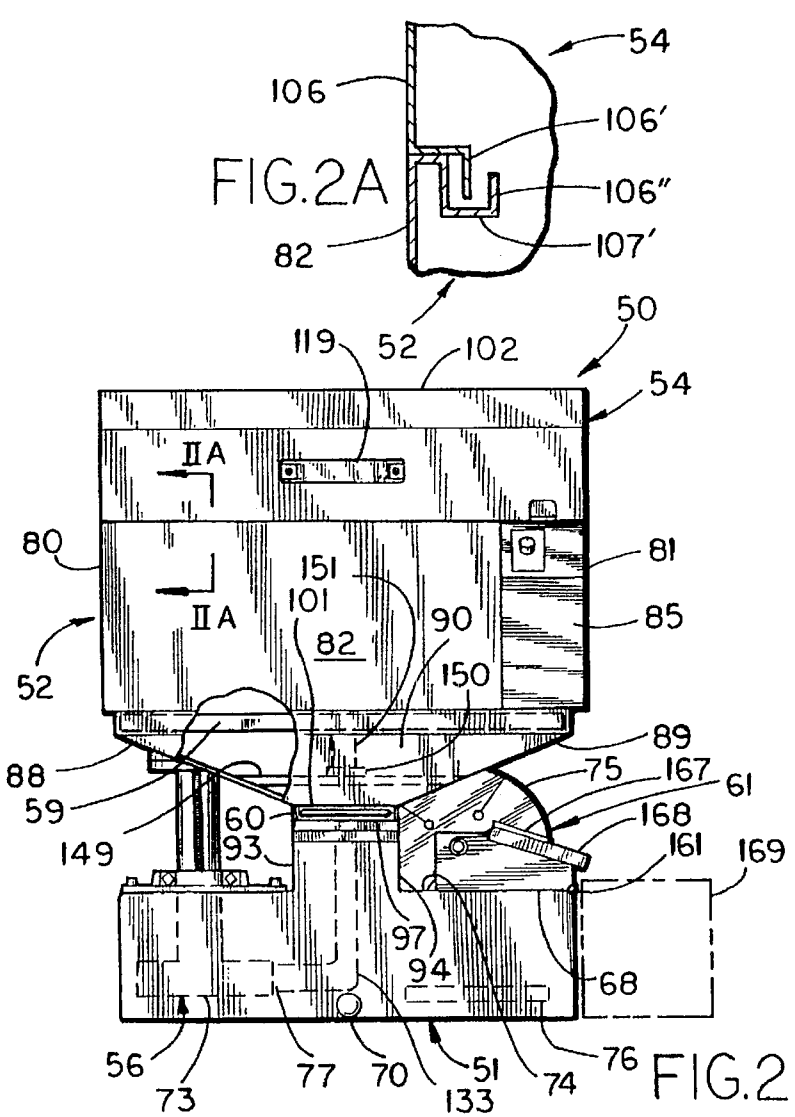
FIG. 2A
FIG. 2
54
106'
106"
107'
106
82
50
54
81
85
89
167
168
161
169
61
75
68
76
74
102
52
119
90
150
151
101
82
97
94
51
133
70
77
60
93
IIA
IIA
73
56
149
59
88
80
52

PARTS WASHER

BACKGROUND OF THE INVENTION

The present invention concerns parts washers, and more particularly concerns portable parts washers adapted to wash oily and dirty automotive parts, such as are often encountered at a car dealership when repairing assemblies and parts used in a vehicle engine compartment or underbody.

It is often desirable and/or necessary to wash oil and debris from parts taken from a vehicle engine compartment or underbody of a vehicle when repairing a vehicle. Many known parts washers include screens for catching debris washed from the parts, but the screens are sometimes too large to be easily removed. Further, the screens are often located down inside the wash cabinets where they are difficult to remove. Still further, lifting a screen can be undesirable where the operator must lean into the washer at an awkward angle to pick up the screen. Another problem is that many known parts washers take up an excessive amount of space, or require space around the parts washer to allow the access door of the parts washer to be opened. Also, many doors to parts washers tend to drip fluid on the floor around the parts washers when opened, potentially creating a safety hazard. Also, some parts washers are limited as to the amount of weight that their turntables can support. This can be a problem where a heavy part such as a transmission casing needs to be cleaned.

As parts washers are used for an extended period of time, many parts washers begin to develop additional problems. For example, many parts washers use rubber seals to seal against water leakage between a lid and the wash chamber. However, the rubber seals degrade and/or crack over time, thus loosing some of their ability to seal. Also, the water heaters of many known parts washers may overheat due to false water level readings caused by a water level float hanging up from oil and grease residue. This allows the water level to go below the water heaters, in which case the water heaters can overheat and/or burn out. Another problem is that the turntable belts for turning turntables in parts washers may become loose and/or slippery, allowing the turntable to remain stationary during a washing cycle. Still further, spray bars in the parts washer may be improperly located or located at less than optimal positions on the sides of the wash chamber, rather than proximate the parts being washed, causing inadequate or poor washing of the parts.

Some existing parts washers also lack repairability. For example, in many parts washers, it is not easy to access the pump that recirculates water in the parts washer. This is particularly problematic since bolts and fasteners will corrode over time, further increasing the difficultly of servicing the pump. Other parts washers include drive systems that are difficult to service, or must be serviced often.

Thus, a parts washer solving the aforementioned problems is desired.

SUMMARY OF THE INVENTION

The present invention concerns a parts washer for washing oily dirty parts, such as are often encountered in a car dealership. The parts washer is compactly designed for use in confined spaces, and for efficient and quality cleaning of parts, as well as for simplicity, durability and repairability.

In one aspect, the present invention includes a parts washer having a wash cabinet with a funnel-shaped bottom defining a narrow section. A fluid recirculating system on the parts washer includes a tank positioned to accept washer fluid flowing from the narrow section and a pump for recirculating liquid back into the wash cabinet. A removable screen is located in the narrow section for catching debris and large particles washed from parts located in the wash cabinet.

In another aspect, the present invention includes a parts washer having a wash cabinet including marginal material defining an access opening. A door is movably connected to the wash cabinet for covering the access opening. The wash cabinet includes a channel defining a lower edge of the access opening, and the door includes a lower flange extending into the channel when the door is closed for defining a tortuous path across the lower edge to prevent liquid within the wash cabinet from being splashed or sprayed out of the wash cabinet between the door and the marginal material during the wash cycle.

In yet another aspect, the present invention includes a parts washer having a wash cabinet, a fluid recirculating system for recirculating washer fluid, and a holding tank for holding washer fluid drained from the wash cabinet. An oil skimmer is pivotally mounted to the holding tank for movement between an oil skimming position and a repair position.

In yet another aspect, the present invention includes a parts washer having a wash cabinet defining an access opening, a recirculating system for recirculating washer fluid in the wash cabinet, and a cover pivoted to the wash cabinet for covering the access opening. A spray bar is pivoted to the wash cabinet, and a mechanism is operably connected to the spray bar and to the cover so that the spray bar swings to a storage position when the cover is opened and swings to an operating position when the cover is closed.

In yet another aspect, the present invention includes a parts washer having a wash cabinet, and a turntable rotatably mounted in the wash cabinet. A flexible band extends around the turntable, and a powering mechanism includes a driving wheel engaging the band. One of the band and the driving wheel includes a rough metal surface and the other of the band and driving wheel includes a resilient material for frictionally non-slippingly engaging the rough metal surface. Thus, the turntable can be driven by the driving wheel and the band substantially with slippage.

In another aspect, the present invention includes a parts washer having a wash cabinet with sidewalls and a funnel-shaped bottom defining a wash chamber, a removable screen located in the funnel-shaped bottom for catch debris in washer fluid flowing out of the wash cabinet, and a cover pivoted to the wash cabinet for closing an access opening defined by the wash cabinet. A collection tank supports the funnel-shaped bottom and is configured to receive washer fluid draining from the funnel-shaped bottom. An oil skimmer is operably attached to the collection tank for skimming oil from washer fluid in the collection tank.

In still another aspect, the present invention includes a parts washer having a wash cabinet, a collection tank supporting the wash cabinet, a heater for heating washer fluid in the collection tank and a recirculating system including an inlet located above the heater and in the collection tank. The recirculating system further includes a spray bar for spraying washer fluid, and a pump for pumping washer fluid from the inlet to the spray bar.

In still another aspect, the present invention includes a parts washer having a wash cabinet defining an interior space and an access opening to the interior space. The parts washer includes a circulating system for spraying fluid in the interior space for washing parts placed therein and further includes a support for supporting the parts in the wash cabinet. A door is pivoted to the wash cabinet for closing the access opening when washing the parts, the door being movable between a closed position covering the access opening and an open position in which the door pivots at least partially into the interior space to uncover the access opening.

The preferred embodiments provide several advantages over known art. The parts washers are compact, and configured to be positioned in tight quarters on limited floor space. The wash cabinets are readily accessible to facilitate cleaning and for placing parts therein. The oil skimmer pivots out of the way to provide access to components in the collection tank. The spray bars are positionable for optimal spray patterns, but so that they do not interfere with loading of parts. Also, the parts washer is designed to provide a structurally rigid and sound cabinet construction to provide for long and reliable service, and for repairability.

These and other features, advantages and objects of the present invention will be further understood and appreciated by those skilled in the art by reference to the following specification, claims and appended drawings.

BRIEF DESCRIPTION OF THE DRAWINGS

FIG. 2 is a front view of the parts washer shown in FIG. 1, the cabinet of the parts washer being partially broken away to show a turntable and a support for the turntable;

FIG. 2A is a cross-sectional view taken along the plane IIA—IIA in FIG. 2;

FIG. 3 is a right side view of the parts washer shown in FIG. 1;

FIG. 3A is a cross-sectional view taken along the plane IIIA—IIIA;

DETAILED DESCRIPTION OF PREFERRED EMBODIMENT

Figures 1, 7, 7A:
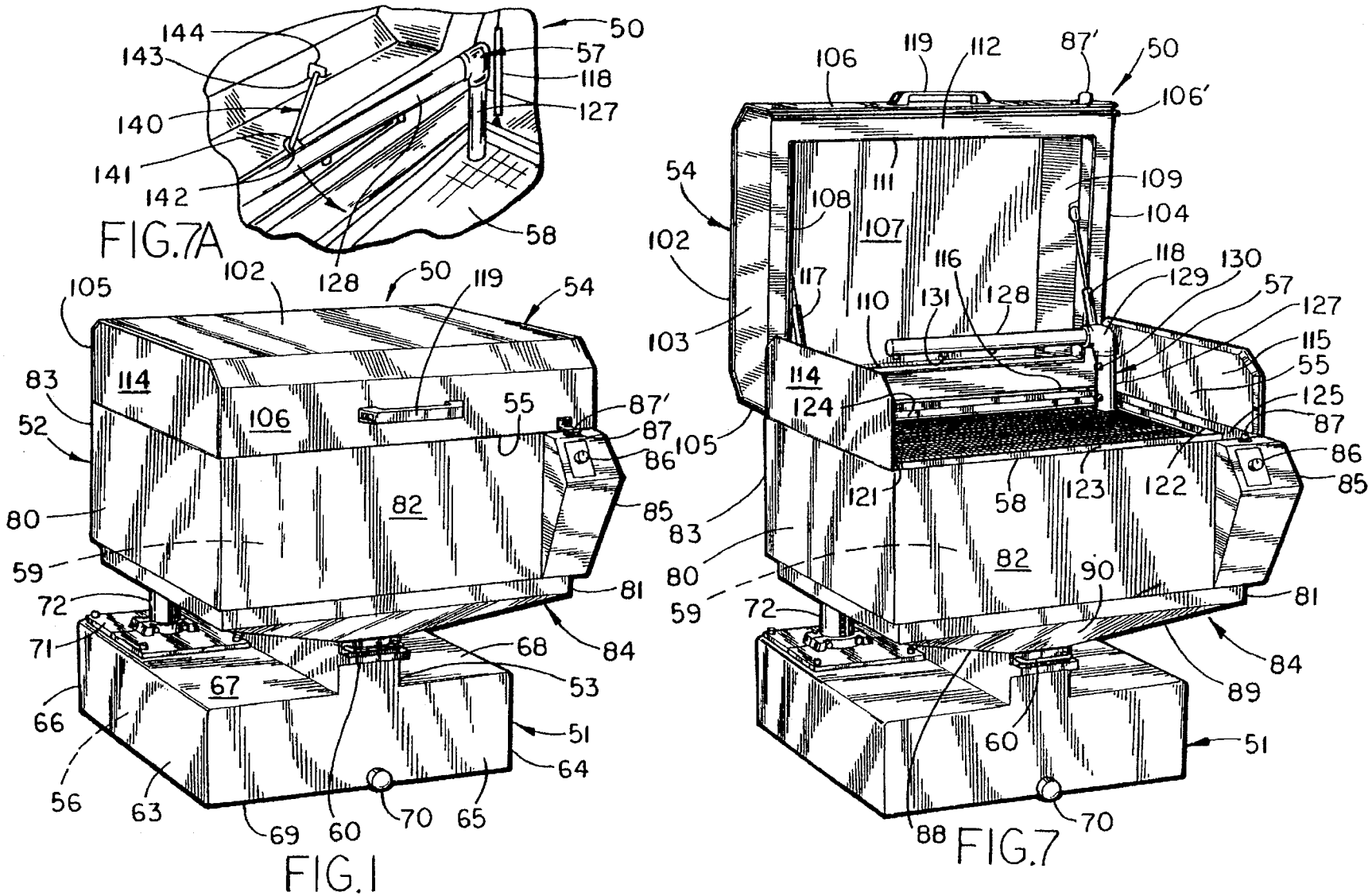
FIG. 1 is a perspective view of a parts washer embodying the present invention.
FIG. 7 is a perspective view of the parts washer shown in FIG. 1, the cover being shown in an open position.
FIG. 7A is a fragmentary perspective view of the cabinet, the cover and a link therebetween shown in FIG. 7.

A parts washer 50 (FIG. 1) includes a reservoir or collection tank 51, and a funnel-bottomed wash cabinet 52 supported on tank 51 by a narrowed section 53. A cover or door 54 is pivoted to wash cabinet 52 for covering the access opening 55 of wash cabinet 52 when operating the parts washer 50. A sump pump 56 (FIGS. 2–3) in tank 51 draws washer fluid or water from tank 51 and pumps the fluid through spray bar 57 (FIG. 7) into wash cabinet 52. A wire mesh tray 58 is located in wash cabinet 52 for supporting small parts to be washed. Wire mesh tray 58 is removable, and an expanded metal turntable 59 (FIG. 2) is located thereunder for supporting heavier and larger parts. A debris screen 60 is slideably supported in narrowed section 53 for ready removal from the front of parts washer 50. An oil skimmer 61 (FIG. 3) is pivotally supported on tank 51 behind wash cabinet 52 and is pivotally movable between a use position (shown in solid lines) and a pivoted position (shown in phantom lines) providing access to the sump pump 56 in tank 51 for servicing. The parts washer 50 provides a compact, efficient and environmentally acceptable system that is optimally sized for stand alone use, such as in a service garage or car dealership.

Figure 4:
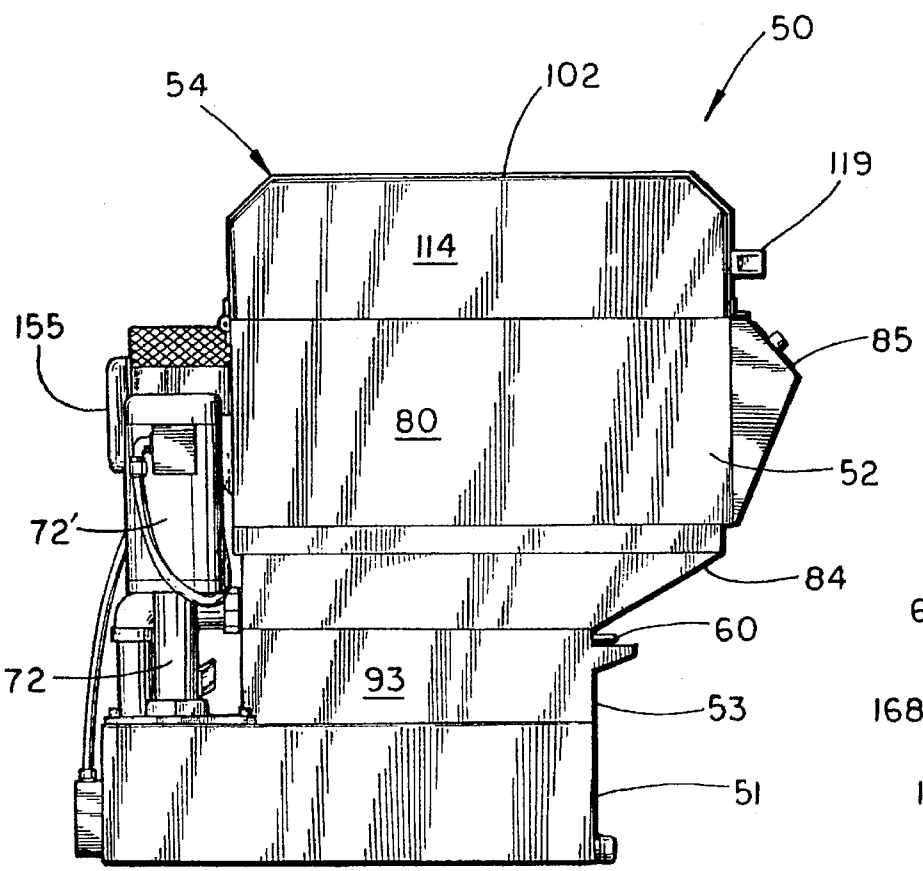
FIG. 4 is a left side view of the parts washer shown in FIG. 1.

More particularly, collection tank 51 (FIG. 1) includes sidewalls 63 and 64, a front wall 65, a rear wall 66, top wall sections 67 and 68, and bottom wall 69. A drain 70 is located at the bottom of front wall 65. The rear of left top wall section 67 includes an apertured cover 71 for receiving a covered drive shaft 72 for driving pump 56 located in tank 51. A motor 72' (FIG. 4) is connected to drive shaft 72. Pump 56 (FIG. 2) includes an inlet 73 and an outlet 77. An aperture 74 is located in the rear of right top wall section 68 for receiving an oil skimmer wheel 75 on oil skimmer 61. A heater 76 is located in tank 51 above bottom wall 69 but below the inlet 73 to pump 56. The location of heater 76 below pump inlet 73 helps prevent accidental heater burnout due to a low water lever. Specifically, by causing pump 56 to draw air before the washer fluid/water lever drops below heater 76, an operator is warned of the low fluid problem before the heater 76 is exposed to air.

Wash cabinet 52 (FIG. 1) includes sidewalls 80 and 81, a front wall 82, a rear wall 83, and a funnel-shaped bottom wall 84. A control panel 85 including a combination of on/off switch and timer 86 is located on front wall 82. A safety switch 87 is also located on control panel 85 for engagement by a tab 87' on cover 54 to indicate that the cover 54 is closed. Funnel-shaped bottom wall 84 (FIGS. 2–3) includes angled sidewalls 88 and 89, an angled front wall 90 and a rear wall 91 that extend from cabinet walls 80–83, respectively, to the corresponding walls of narrowed section 53. Narrowed section 53 includes sidewalls 93 and 94, a front wall 95 and a rear wall 96. An aperture 97 in front wall 95 receives the screen 60. A pair of angled beams 98 attach to the inside of sidewalls 93 and 94 to form a slideably engageable track aligned with aperture 97 for receiving and supporting screen 60. Screen 60 (FIG. 3A) includes a rigid rectangular frame 99 and a wire mesh screen element 100 supported therein for catching debris and large particles washed from parts within wash cabinet 52. A U-shaped handle 101 (FIG. 2) is attached to the front of screen frame 99. Screen 60 is elongated and narrow, such that its shape generally matches the configuration of narrowed section 53. The front mounting of screen 60 and its shape provide for easy removal from wash cabinet 52 and for its ready transport to a dump location.

Cover 54 (FIG. 7) includes a top wall 102, sidewalls 103 and 104, a rear wall 105 and a front wall 106. A plurality of inwardly spaced walls 107–111 are connected to outer walls 102–106 by a panel 112 that extends therebetween. A chamber is formed in cover 54 between inner walls 107–111. A pair of upright panels 114 and 115 extend about wash cabinet sidewalls 80 and 81. Cover 54 is pivotally connected to wash cabinet 52 at the top of cabinet rear wall 83 by hinges 116. When cover 54 is closed, cover sidewalls 103 and 104 are located between and adjacent upright panels 114 and 115. Cover 54 is supported by gas springs 117 and 118 that assist in lifting cover 54 and in holding cover 54 in a raised position. A cover handle 119 is attached to cover front wall 106. The tab 87' is attached to cover front wall 106 for engaging safety switch 87 on control panel 85. The front lip or edge 106' (FIG. 2A) of front wall 106 is offset so that it mateably engages a channel 106" along the front wall 82 of cabinet 52 to create a water seal therealong. Drain holes 107' drain water from channel 106".

As shown in FIG. 7, the removable rectangular expanded metal tray 58 for holding small light weight parts is positioned on a rectangular pattern of inwardly projecting supports 121–124 attached to the inside of cabinet walls 80–83, respectively. Supports 121–124 include upright legs that form a U-shaped channel 125 with cabinet walls 80–83 for mateably receiving the lower perimeter edge of cover 54. In particular, panel 112 is received in the channel 125, such that an overlapping arrangement is formed around cover 54 when cover 54 is closed. The overlapping arrangement prevents washer fluid from being sprayed from the cabinet 52 when operating the parts washer 50. Drain holes are located in the channel 125 to prevent excess water from accumulating in channel 125.

Spray bar 57 (FIG. 7) includes a vertical pipe section 127 and a horizontal pipe section 128 connected by a 90° elbow 129. Nozzles 130 and 131 are positioned along pipe sections 127 and 128 for spraying washer fluid in wash cabinet 52. Vertical pipe section 127 is located in a rear corner of wash cabinet 52 so that it does not interfere with turntable 59. Elbow 129 rotates on the threads of vertical pipe section 127 to provide the rotational movement of horizontal pipe section 128 as described below.

Figure 10:
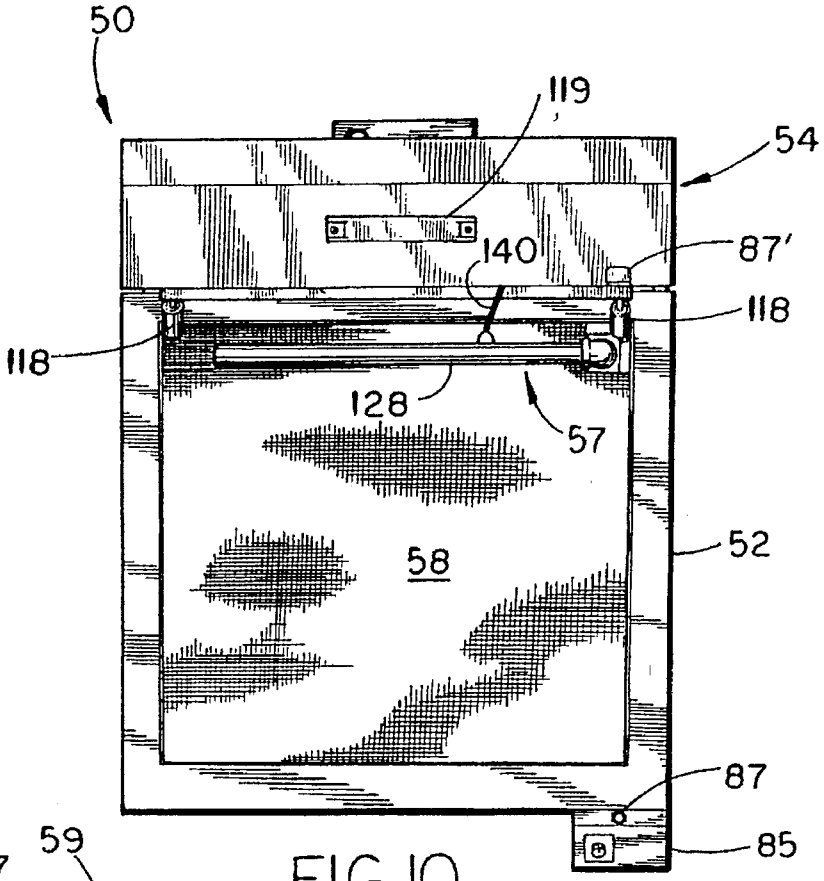
FIG. 10 is a plan view of the parts washer shown in FIG. 7 with the cover being shown in an open position.
Figure 6A:
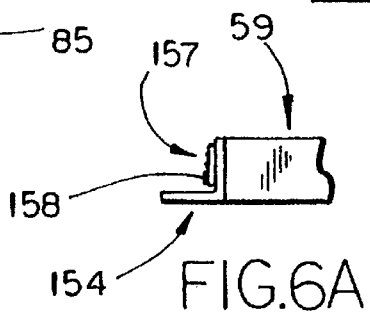
FIG. 6A is a cross-sectional view taken along the plane VIA—VIA in FIG. 6.
Figure 6:
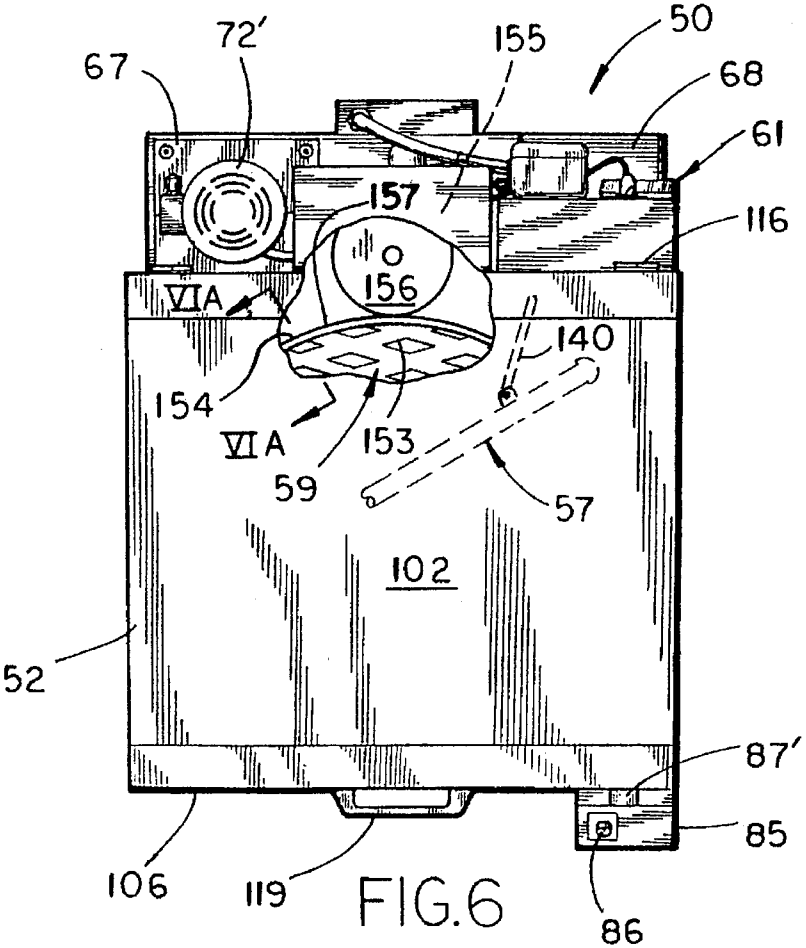
FIG. 6 is a plan view of the parts washer shown in FIG. 1, the cover and rear panel being broken away to expose a turntable and drive mechanism.
Figure 9:
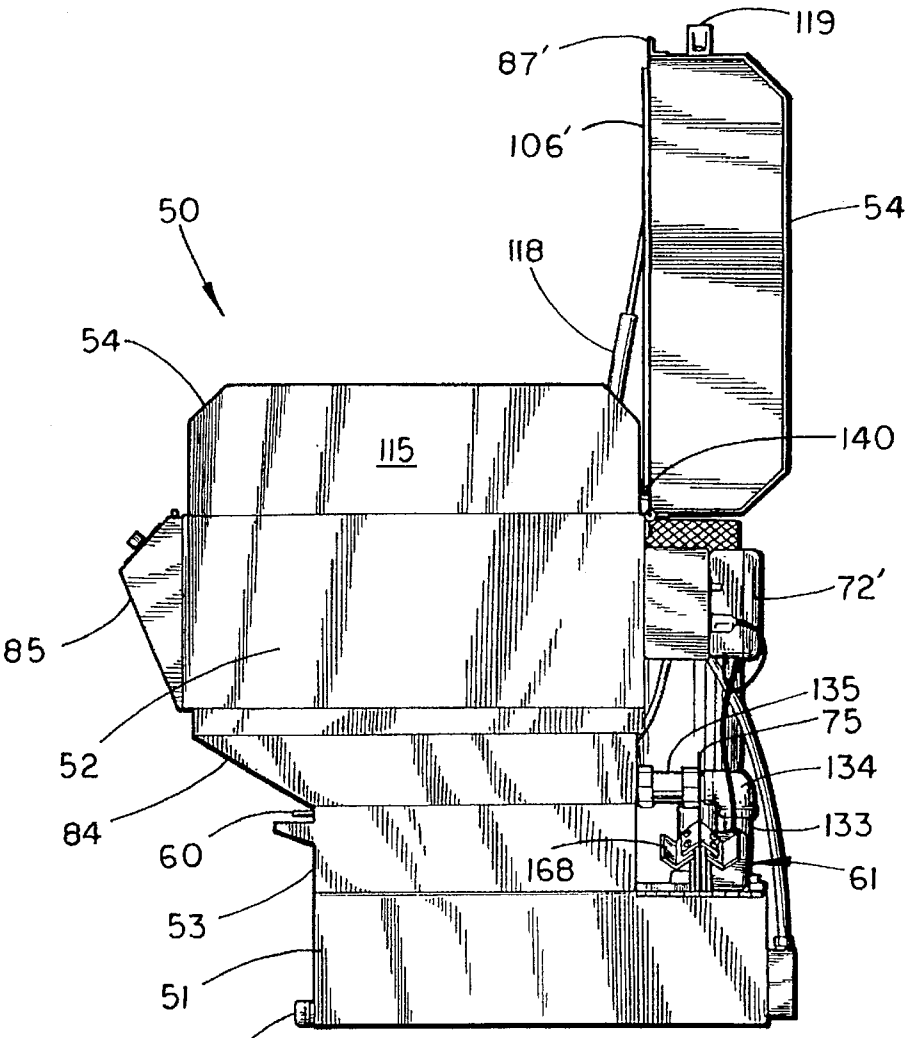
FIG. 9 is a side view of the parts washer shown in FIG. 7 with the cover being shown in the open position.
Figure 8:
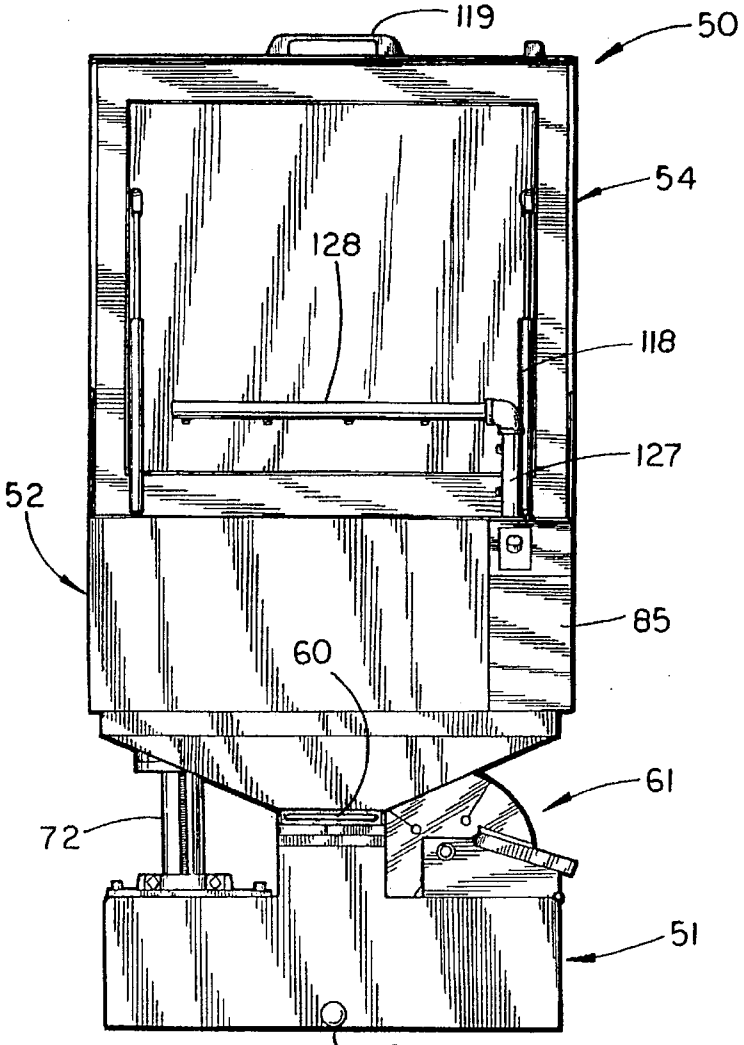
FIG. 8 is a front view of the parts washer shown in FIG. 7 with the cover being shown in the open position.

The recirculating system (FIGS. 2–3) for parts washer 50 includes pump 56 having the inlet 73 and outlet 77, spray bar 57 and the plumbing in between. In particular, washer fluid is delivered to spray bar 57 from pump 73 through pump outlet pipe 133 (FIG. 3), elbow 134, intermediate pipe 135, second elbow 136, and the vertical pipe 127. The rotation of elbow 129 on vertical pipe 127 allows the spray bar 57 to rotate about a vertical axis 139. Spray bar 128 connects to elbow 129 which rotates on the threads of vehicle pipe section 127. A mechanical linkage 140 (FIG. 7A) connects spray bar 57 to cover 54 so that spray bar 57 is positioned generally centrally in wash cabinet 52 when cover 54 is closed (FIG. 6). The mechanical linkage 140 further retracts spray bar 57 when cover 54 is opened (FIG. 10). In particular, mechanical linkage 140 (FIG. 7A) comprises a bent wire link pivotally retained at a hooked end 141 to horizontal pipe section 128 of spray bar 57 by an apertured L-shaped bracket 142 on section 128. Link 140 includes a second L-shaped end 143 that is pivotally attached to cover 54 by a second L-shaped bracket 144. As cover 54 is opened, link 140 pulls on horizontal pipe section 128 of spray bar 57 causing spray bar 57 to move to the retracted position with horizontal pipe section 128 located at the rear of wash cabinet 52. Alternatively, as cover 54 is closed, link 141 imparts a rotational force on horizontal pipe section 128 such that spray bar 57 is rotated to a position where horizontal pipe section 128 is generally diagonally located across wash cabinet 52.

Turntable 59 (FIG. 2) is located in wash cabinet 52 generally at the bottom thereof. A turntable support 149 comprising an X-shaped pattern of beams is attached to the corners of funnel bottom sidewalls 88–91. The beams 149 are welded to the angled corners of funnel-shaped bottom 84, where the structure of the corner provides structurally rigid support therefore. Bearing 150 for supporting an axle 151 of turntable 59 is connected to support 149. The angled walls 88–90 and rear wall 91 form a rigid structure allowing turntable 59 to carry a significant weight without fear of buckling the angled walls 88–90 and rear wall 91.

Turntable 59 (FIG. 6) includes an expanded metal table 153 bounded by a rigid L-shaped perimeter frame 154. A drive motor 155 is positioned on the rear wall 83 of wash cabinet 52. Drive wheel 156 is connected to drive motor 155 by means of a set screw bearing on output shaft of drive motor 155. A "traction strip" (pricked metal strip) is riveted to frame 154 to create a non-slip surface against which drive wheel 156 engages to turn the turntable 153 (FIG. 6).

Oil skimmer 161 (FIG. 3) includes a platform 160 pivoted to the rear of collection tank 51 by a hinge 161. By pivoting oil skimmer 61 to a retracted position (shown in phantom lines in FIG. 3), an aperture into tank 51 is uncovered. This allows the components such as pump 73, heater 76, and the various pipes within tank 51 to be inspected or serviced without major disassembly of the parts washer 50.

Figure 5:
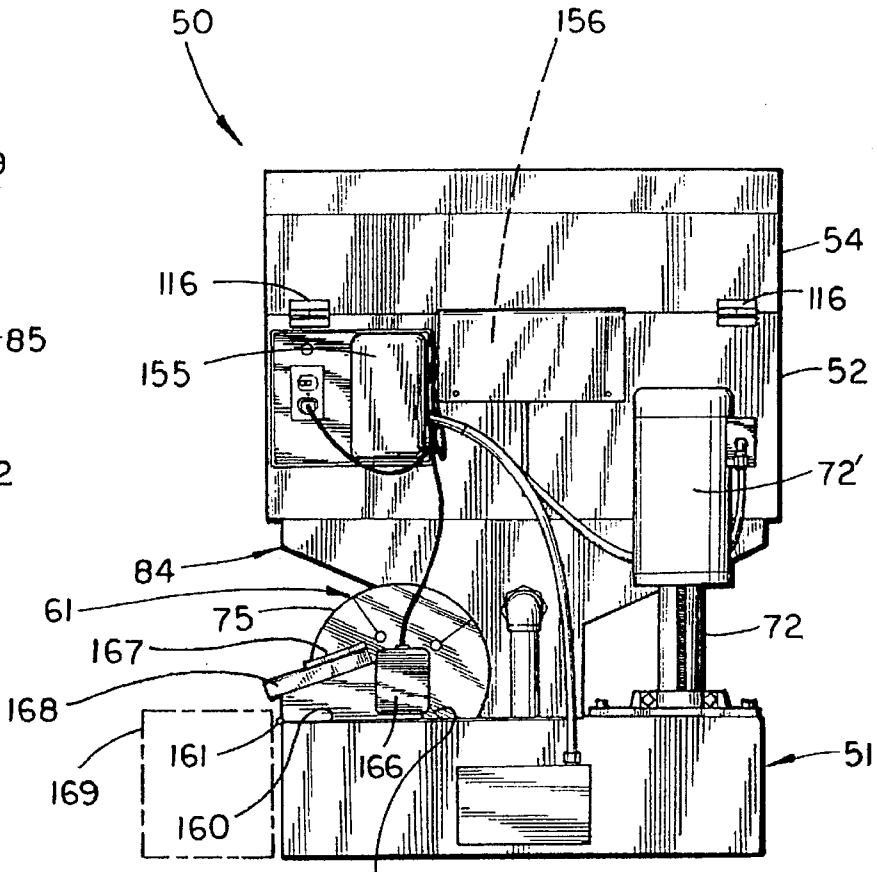
FIG. 5 is a rear view of the parts washer shown in FIG. 1.

Oil skimmer 61 (FIG. 5) includes a bearing stand 164 attached to the rear of top wall 68 on platform 160. The oil skimmer wheel 75 is rotatably supported on bearing stand 164. In the operative position, wheel 75 extends through the aperture in tank 51 into washer fluid within tank 51. A motor 166 is connected to an axle on wheel 75 to rotate wheel 75. A resilient squeegee-like wiper 167 is positioned adjacent wheel 75 to wipe oil from wheel 75 as it is rotated. Oil skimmer wheel 75 is made of a stiff material to which oil adheres as wheel 75 is rotated through the water in tank 51, and wiper 167 is made of a resilient rubber-like material for rubbing the collected oil from wheel 75 as wheel 75 is rotated. The oil wiped from wheel 75 runs down wiper 167 into an angled V-shaped trough 168, which directs the skimmed oil into a catch bucket 169.

Oily dirty parts are loaded into cabinet 52 of parts washer 50, either onto tray 58 or turntable 59. Cabinet cover 54 is then closed. As cover 54 is closed, link 140 moves spray bar 57 outwardly generally centrally in cabinet 52. A time is set on timer 86 to begin the washing cycle, and parts washer 50 is started. It is immediately apparent to the operator if the washer fluid level is below the pump inlet 73 due the sound coming from the washer 50. Washer fluid is funneled by funnel-shaped bottom wall 84 into and through screen 60. Washer fluid is recycled by pump 73 from tank 51 back into wash cabinet 52 through spray bar 57. The configuration of cover 54 provides a "water seal" effect where the edges of cover 54 protrude into channel 125. This arrangement allows water to fill channel 125 to a level where perimeter edges of cover 54 come in contact with the water, thus preventing steam or splashing water to escape cabinet 52. When the wash cycle is complete and cover 52 is opened, spray bar 57 is moved out of the way by link 140. As cover 52 is opened, safety switch 87 is disengaged to prevent accidental operation of parts washer 50 when cover 52 is opened. The washer fluid can be preheated by heater 76 or heated during washing as desired by controls on the parts washer 50. Screen 60 is easily removed from a front of parts washer 50 for cleaning as desired. Oil skimmer 61 operates to remove oil floating in collection tank 51 as parts washer 50 is operated. Conveniently, oil skimmer 61 can be pivoted out of the way to inspect and/or service pump 73.

An enlarged parts washer 50A embodying the present invention is shown in FIGS. 11–22. Washer 50A includes many features comparable or identical to washer 50. Thus, to reduce redundant discussion, comparable features are identified with identical numbers, but with the addition of the letter "A."

Parts washer 50A (FIG. 11) includes collection tank 51A comparable to tank 51, but enlarged for increased capacity. Tank 51A is mounted on a pair of spaced apart beams 180 forming a space under tank 51A for receiving a fork of a material handling fork track or the like.

Figure 17:
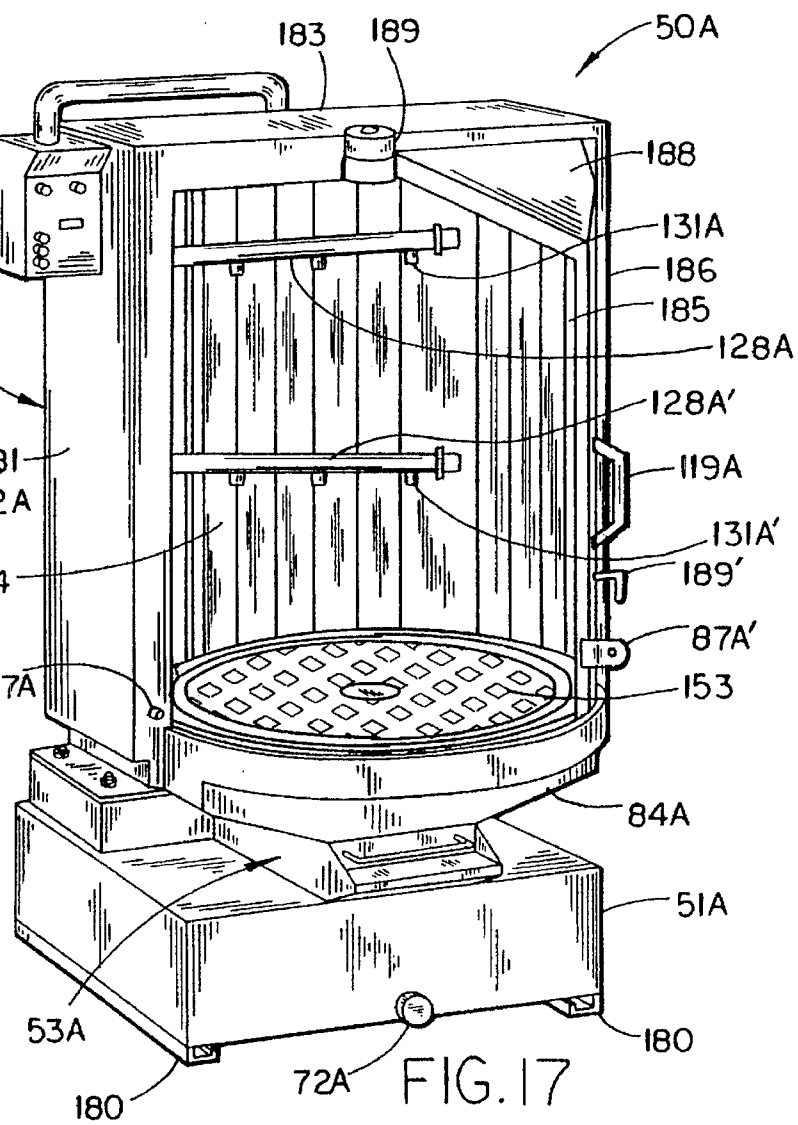
FIG. 17 is a perspective view of the parts washer shown in FIG. 11, the door or cover being shown in an open position.
Figure 11:
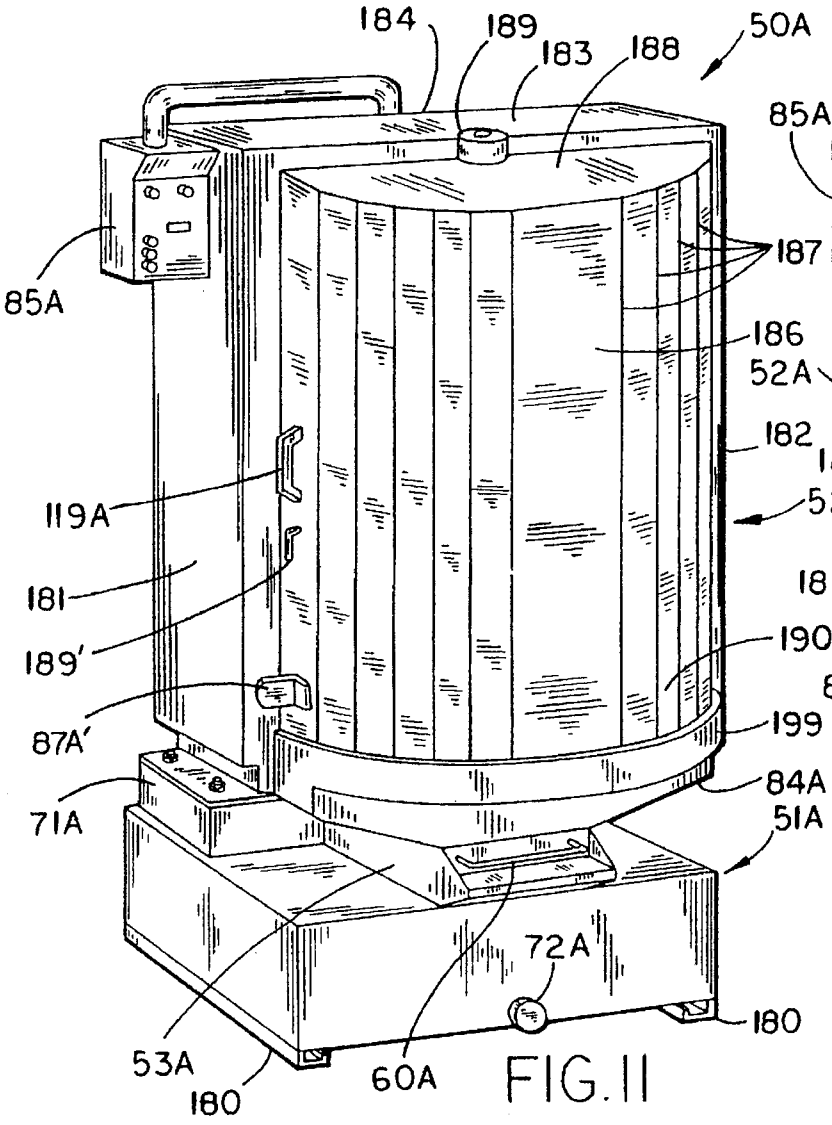
FIG. 11 is a perspective view of another parts washer embodying the present invention.
Figure 13:
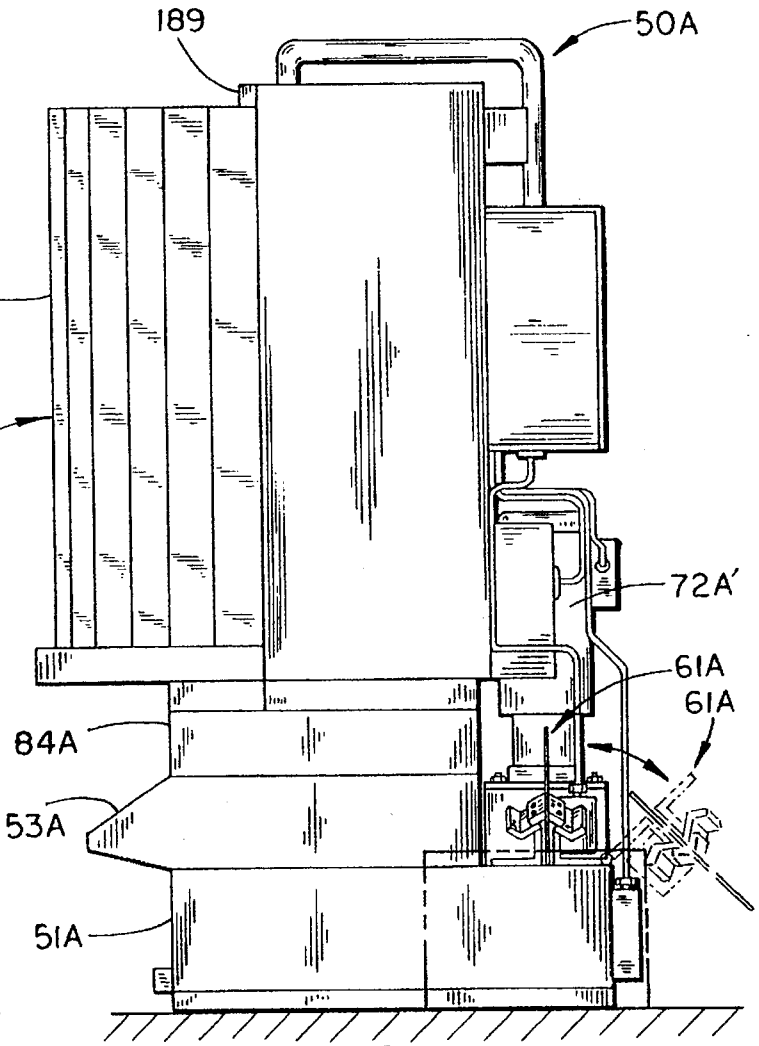
FIG. 13 is a right side view of the parts washer shown in FIG. 11, the oil skimmer being shown in solid lines in a use position and in dashed lines in a pivoted position for allowing access to a sump pump.
Figure 12:
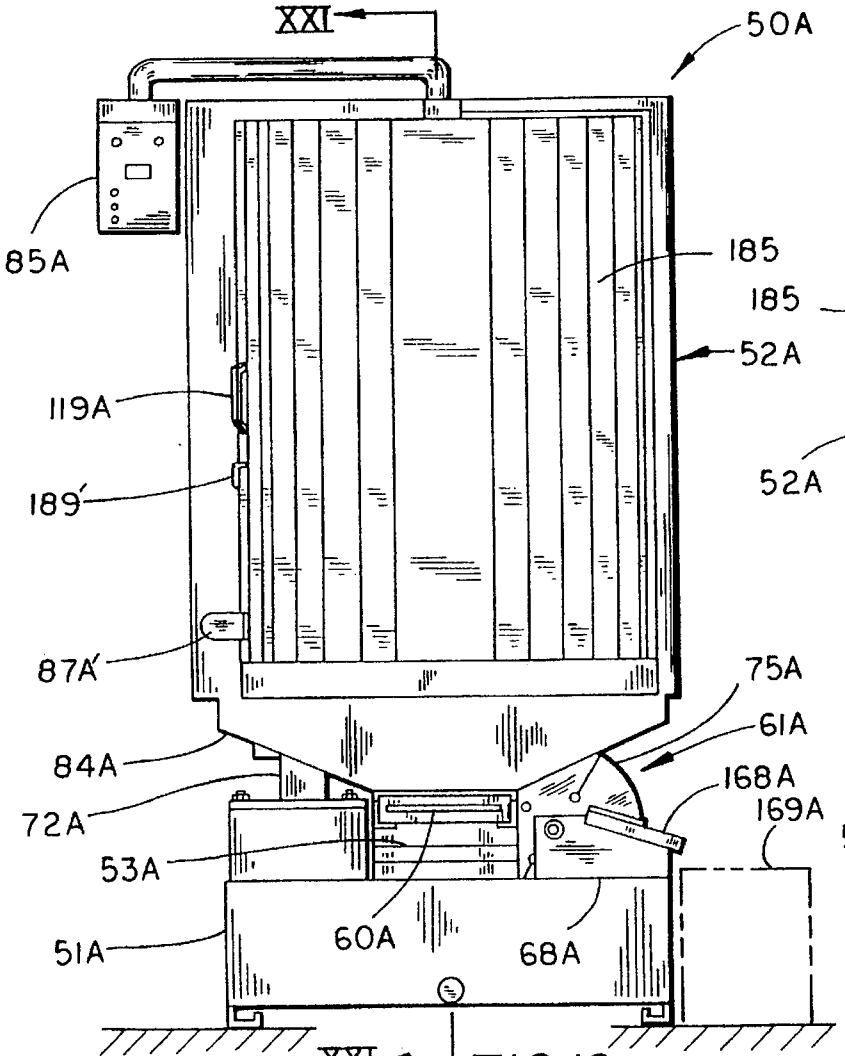
FIG. 12 is a front view of the parts washer shown in FIG. 11.
Figure 15:
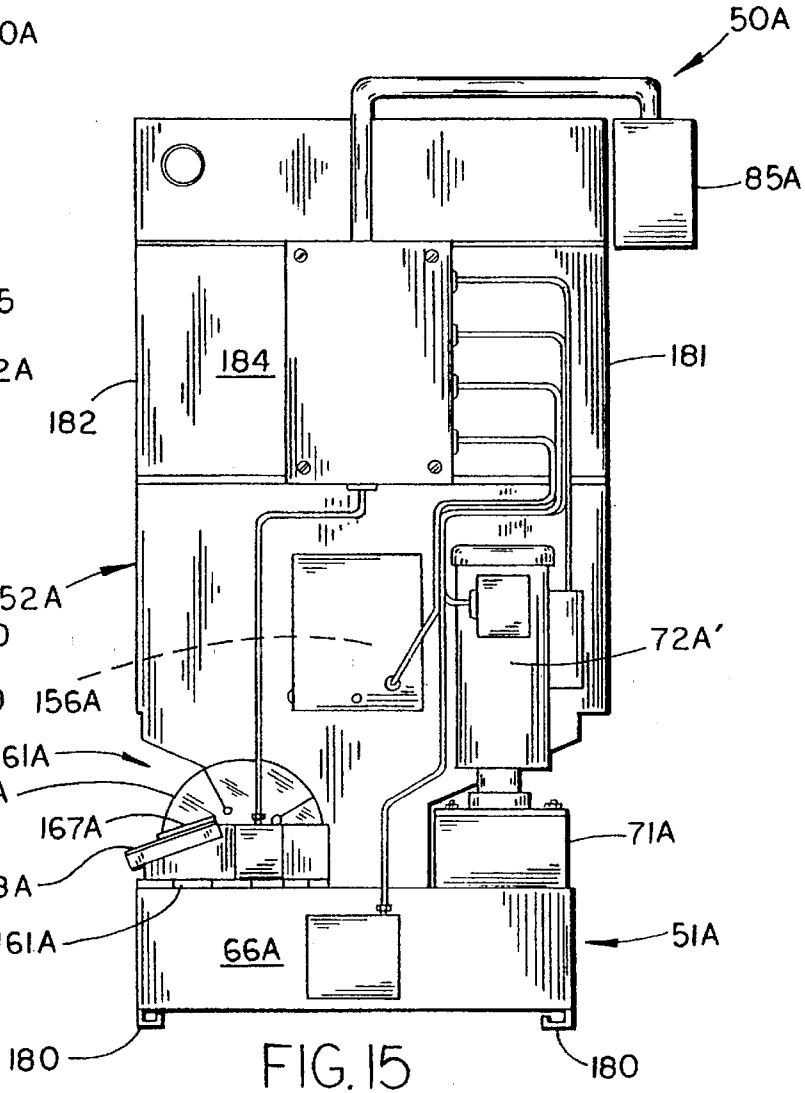
FIG. 15 is a rear view of the parts washer shown in FIG. 11.
Figure 14:
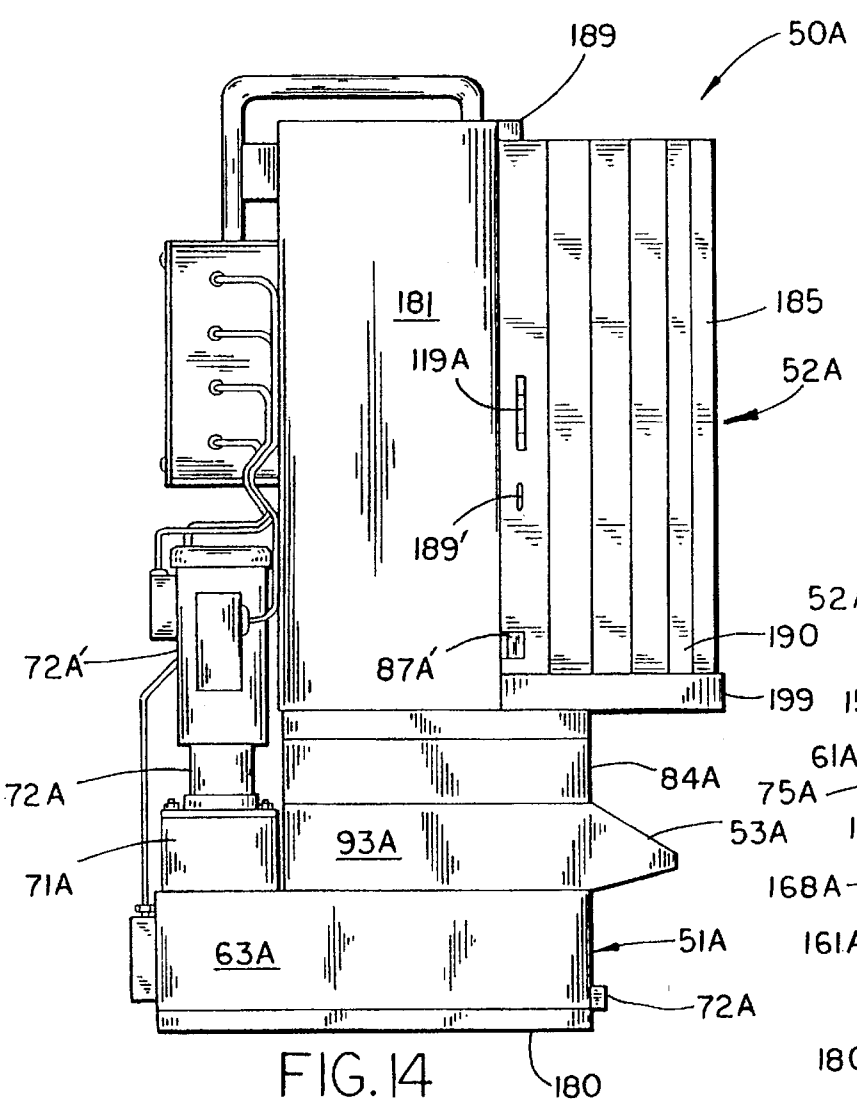
FIG. 14 is a left side view of the parts washer shown in FIG. 11.
Figure 20:
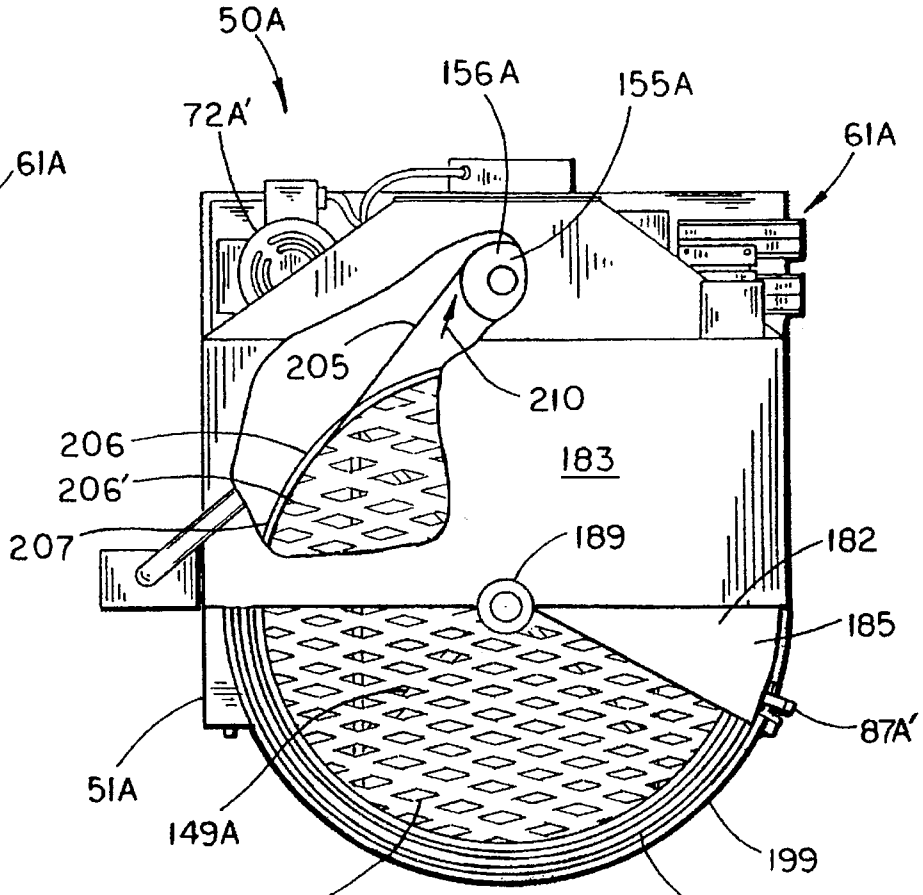
FIG. 20 is a plan view of the parts washer shown in FIG. 17, the door being shown in an open position and the cabinet being broken away to reveal the turntable drive mechanism.
Figure 16:
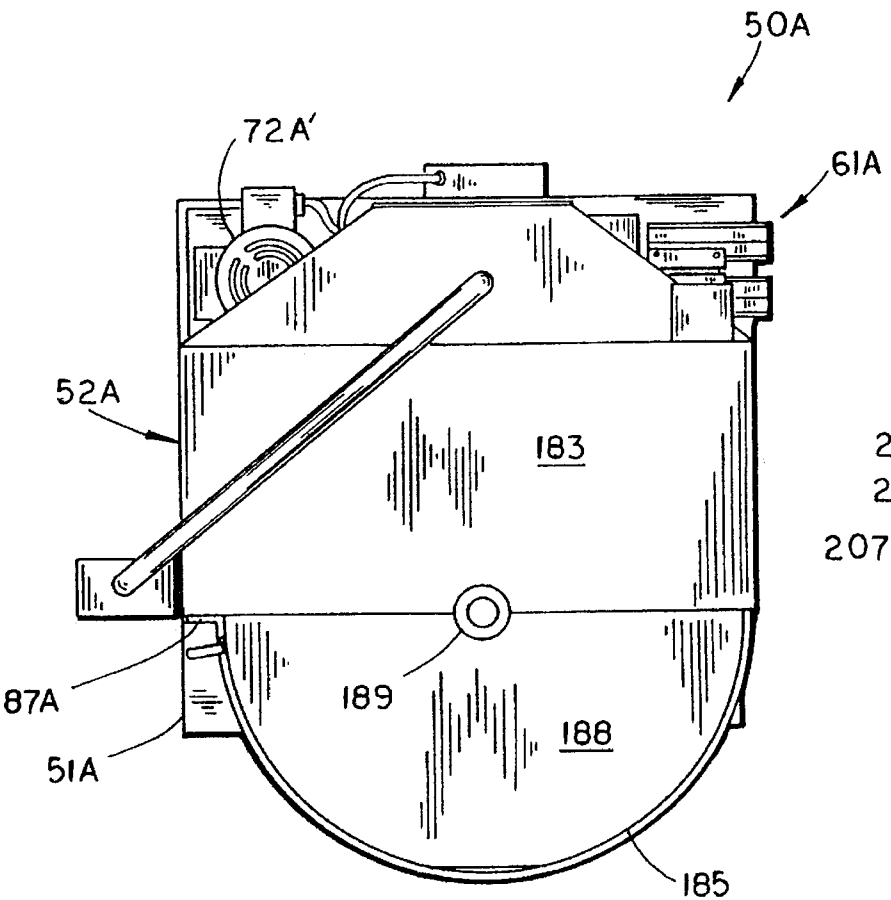
FIG. 16 is a plan view of the parts washer shown in FIG. 11.
Figure 19:
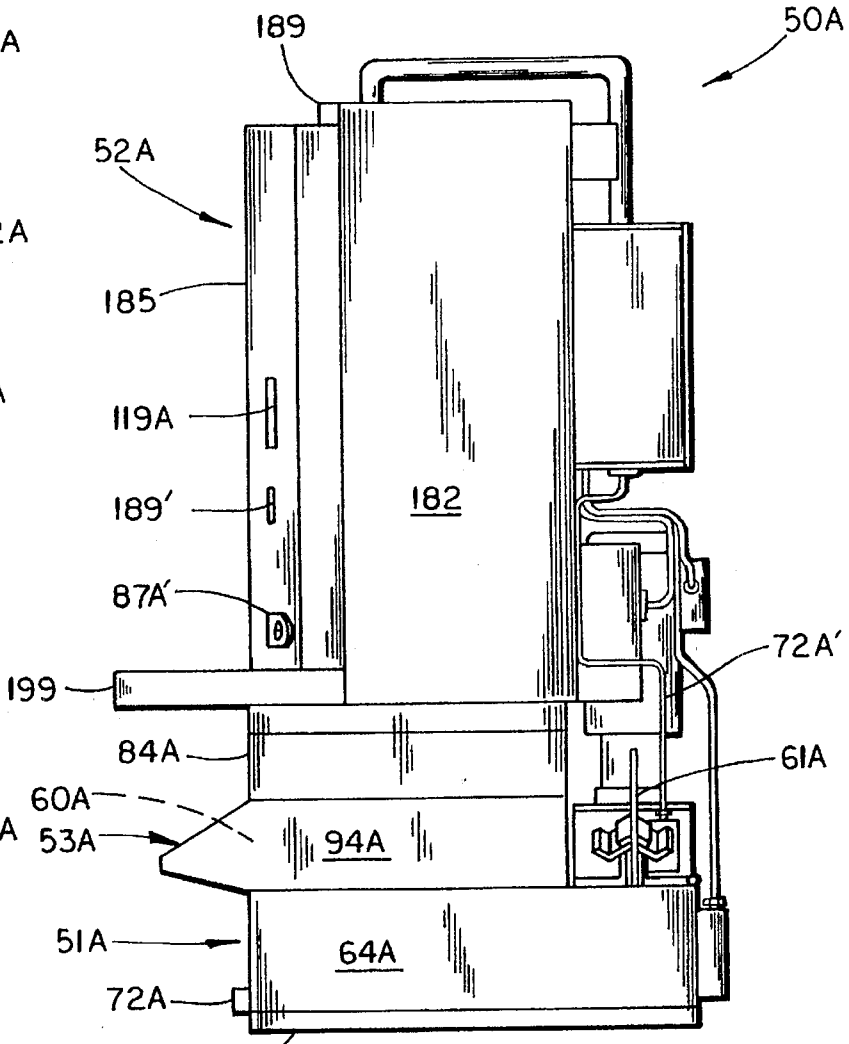
FIG. 19 is a right side view of the parts washer shown in FIG. 17, the door being in the open position.
Figure 18:
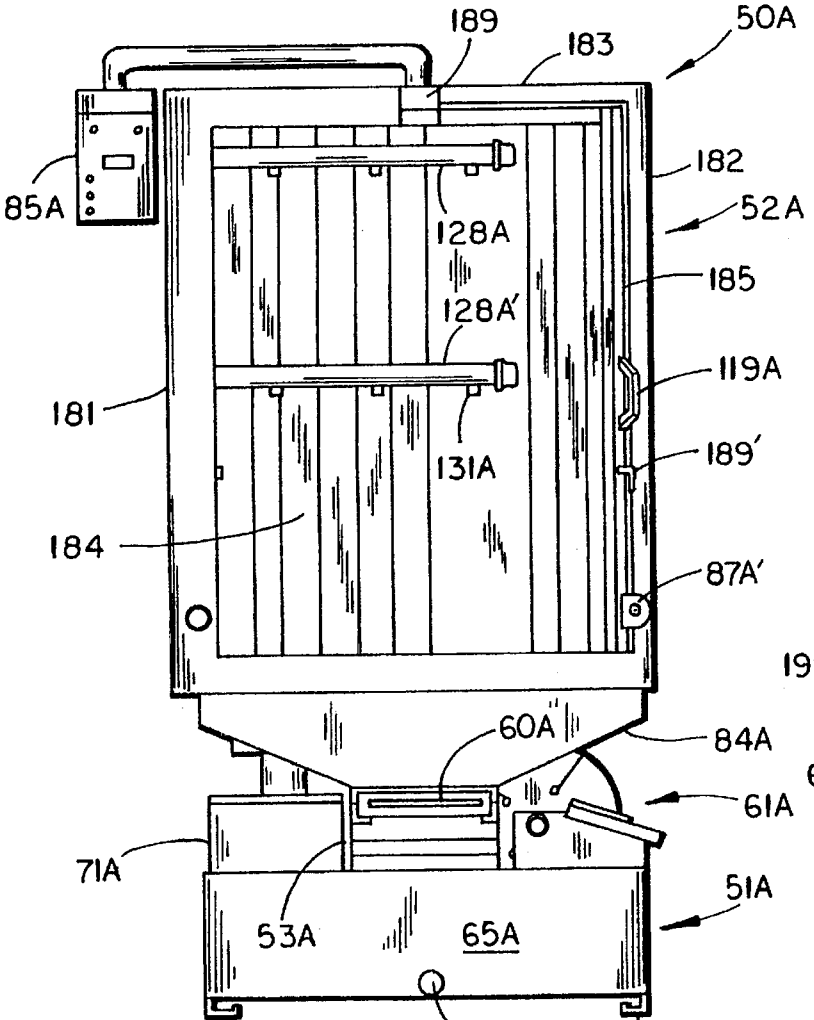
FIG. 18 is a front view of the parts washer shown in FIG. 17, the door being in the open position.
Figure 21:
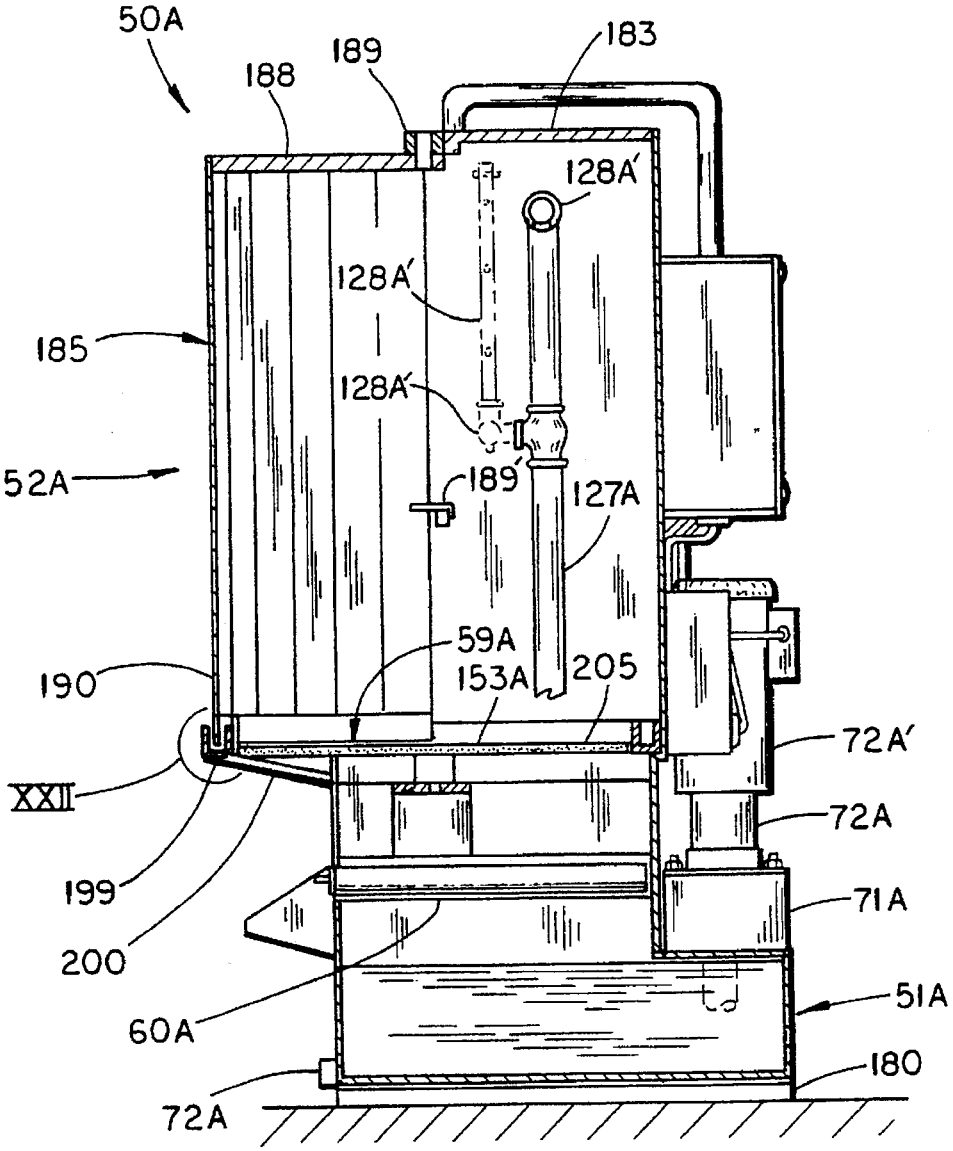
FIG. 21 is a cross-sectional view taken along the plane XXI—XXI in FIG. 12.
Figure 22:
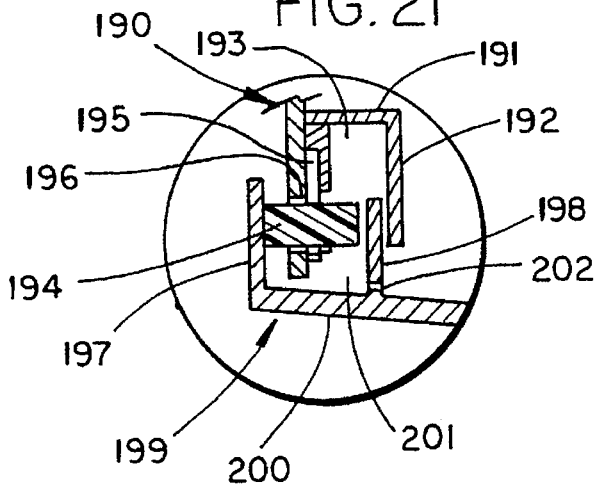
FIG. 22 is an enlarged cross-sectional view of the channel along the bottom of the access opening including the bottom edge of the door.

The wash cabinet 52A is modified to permit front loading of the cabinet. In particular, wash cabinet 52A includes sidewalls 181 and 182, a top wall 183, a rear wall 184 and a funnel-shaped bottom wall 84A. The front edges of wall 181, 182, 183 and 84A define a forwardly facing access opening 184. A cover or door 185 is operably mounted to wash cabinet 52A to cover access opening 184 (FIG. 17). Door 185 includes a semicylindrically-shaped sidewall 186 having multiple vertical stiffening bends 187 therein, and a semicircularly planar top wall 188. Door 185 is rotatably mounted to cabinet top wall 183 by bearing 189 for pivotal movement between a closed position (FIG. 11) and an open position (FIG. 17). Beating 189 carries the weight of door 185, and top wall 183 is reinforced accordingly. A lock 189' is configured to securely hold door 185 in a closed position. When door 185 is opened, door 185 rotates into the interior space of the wash cabinet and around turntable 153, thus allowing wash cabinet 52A to be situated in close quarters, and accessible for operation, where an otherwise outwardly pivoting door would not. Door 185 when rotated inwardly, with lower edge 190 extending into channel 201 prevents wash solution to drip onto floor during any position or point of rotation.

The lower edge 190 (FIG. 22) of door 185 includes an angled beam or flange 191 that extends along the perimeter of its lower edge 190. The angled beam or flange 191 includes a downwardly extending vertical leg 192 that creates a pocket 193 between leg 192 and lower edge 190. A plurality of wheels 194 are supported on vertical axles 195 operably attached to the inside of lower door edge 190. Part of wheel 194 extends through an aperture 196 in the lower edge 190 of door 185, and another part of the wheel 194 extends toward leg 192. A pair of spaced apart vertical webs 197 and 198 are formed around the front edge 199 of funnel bottom front wall 200. Webs 197 and 198 form a channel 201 therebetween for receiving wheels 194. Wheels 194 roll along within channel 201 as the door 185 is opened and closed. When door 185 is closed, the overlapping arrangement of leg 192, web 198, door lower edge 190 and web 197 form a tortuous path to prevents the escape of washer fluid being sprayed within wash cabinet 51A. Drain holes 202 in inner web 198 drain away washer fluid that collects in channel 201 to prevent washer fluid from building up beyond a predetermined level. The water and the washer fluid caught in channel 201 forms a water seal around the lower edge of door 185.

Control panel 85A (FIG. 17) is located on an upper part of cabinet sidewall 80A. Safety switch 87A is located on the front edge of sidewall 80A, and tab 87A' is located on door 185 for engaging switch 87A when door 185 is closed.

Narrowed section 53A at the bottom of cabinet 52A is enlarged compared to narrowed section 53, however the shape and general function of narrowed section 53A is the same. The sidewalls 93A and 94A of narrowed section 53A are extended forwardly to pivotally protect handle 101A on screen 60A. Spray bar 57A (FIG. 17) includes a pair of horizontal pipe sections 128A and 128A'. The illustrated spray bar 57A is not automatically moved as door 185 is opened and closed, however it is contemplated that spray bar 57A could be made to automatically moveable by including a link on the trailing edge of door 185 that engages a bracket on spray bar 57A. Spray bar 128A' (FIG. 21) is manually pivotable between a lowered position (shown in solid lines) and a latched raised position (shown in phantom lines), so that it can be selectively positioned depending on the size of the part on turntable 153A. Spray bar 128A' sprays washer fluid in both positions without the use of valves.

Turntable 59A is supported by supports 149A (FIG. 20) not unlike supports 149 on parts washer 50. A motor 155A drives a turntable drive sprocket 156A. A roller chain 205 extends around drive sprocket 156A and around the edge of turntable 59. The edge of turntable 59A includes an L-shaped rim 206 having a vertical leg 206' and an outwardly extending horizontal leg 207. The outer surface of leg 206 engages roller chain 205, while the outwardly extending leg 207 supports roller chain 205 and holds roller chain 205 on leg 206 and against vertical leg 206'. A spring belt tensioner biases motor 155A away from turntable 59A in a direction 210 to keep a consistent tension on roller chain 205. The oil skimmer 61A of parts washer 50A is identical to oil skimmer 61 on parts washer 50.

Oily dirty parts are loaded into cabinet 52A of parts washer 50A onto turntable 59. Intermediate spray bar 128A' is positioned horizontally or vertically as desired. Cabinet door 185 is then closed, with the lower edge of door 185 being guided by wheels 194 engaging channel 201 but the weight of door 185 being supported by top mounted bearing 189. As cover 185 is closed, switch 87A is contacted to allow operation of the pump. The time is set on the controls on control panel 85A, and parts washer 50A is then started. As washer fluid is sprayed within the wash cabinet 50A, the lower edge of door 185 is sealed by washer fluid captured in channel 201. Oil skimmer 61A also operates as parts washer 50A is operated. When door 185 is opened, switch 87A is opened to prevent accidental operation of parts washer 50A with the door open. Front mounted screen 60A is cleaned as desired.

Thus, parts washers having funnel bottom wash cabinets are provided for efficient collection of washer fluid. A screen is conveniently mounted in the funnel bottom for removal of debris and for cleaning. The turntable is mounted on the angled sidewalls of the funnel-shaped bottom for rigid support of the turntable. Other features are also included to improve the efficiency, repairability and long term effective use of the parts washers.

In the foregoing description, it will be readily appreciated by those skilled in the art that modifications may be made to the invention without departing from the concepts disclosed herein. Such modifications are to be considered as covered by the following claims, unless these claims by their language expressly state otherwise.

The embodiments of the invention in which an exclusive property or privilege is claimed are defined as follows:

1. A parts washer comprising:

a wash cabinet including marginal material defining an access opening;

a door movably connected to said wash cabinet for covering said access opening;

said wash cabinet including a channel extending along a lower edge of said access opening, said channel having a bottom wall and spaced, upwardly extending, inner and outer webs, said webs having free edges spaced from said bottom wall;

said door including a lower flange extending into said channel between said inner and outer webs and terminating at a position spaced above said bottom wall for defining a tortuous path across said lower edge to prevent liquid within the wash cabinet from being splashed or sprayed out of said wash cabinet between said door and said marginal material, said lower flange including inner and outer sides, said outer side facing said outer web, said inner side facing said inner web; and at least one bearing secured to said lower flange of said door, said bearing positioned on said flange within said channel and extending beyond each of said inner and outer sides of said flange toward said inner and outer webs for guiding said door in said channel as said door is opened and closed.

2. A parts washer as defined in claim 1 wherein said lower flange of said door extends below said bearing for further preventing the liquid within the wash cabinet from being splashed or sprayed out of said wash cabinet between said door and said marginal material.

3. A parts washer as defined in claim 2 wherein said bearing includes a wheel.

4. A parts washer as defined in claim 3 wherein said door includes an aperture in said lower flange, said wheel extending through said aperture and rotating about a vertical axis.

5. A parts washer as defined in claim 1 wherein said channel defines a liquid trough for catching some of the washer fluid being sprayed in said cabinet as said parts washer is being operated to form a liquid/fluid seal along said lower edge.

6. A parts washer as defined in claim 5 wherein said inner web includes a plurality of apertures for draining liquid collected within said channel back into said wash cabinet.

7. A parts washer as defined in claim 1 wherein said door pivots into an interior space defined by said wash cabinet when said door is opened.

8. A parts washer as defined in claim 1 wherein said door is pivotally supported from a top wall of said wash cabinet.

9. A parts washer comprising:

a wash cabinet defining an interior space and including an access opening to said interior space, said wash cabinet including a channel positioned along a lower edge of said access opening, said channel including a bottom wall and spaced, upwardly extending inner and outer webs, each of said webs having a free edge spaced from said bottom wall;

a circulating system for spraying fluid in said interior space for washing parts placed in said wash cabinet;

a support for supporting the parts in said wash cabinet; and a door pivoted to said wash cabinet for closing said access opening when washing the parts, said door being moveable between a closed position covering said access opening and an open position in which said door pivots at least partially into said interior space to uncover said access opening, said door including a lower edge extending into said channel between said inner and outer webs, said lower edge including an inwardly projecting flange extending over said free edge of said inner web of said channel, whereby said channel, lower edge, and flange define a tortuous path to prevent liquid within the wash cabinet from being splashed or sprayed out of said wash cabinet between said door and said channel.

10. A parts washer as defined in claim 9 wherein said wash cabinet includes a sidewall, and said door pivots to a position juxtaposed along an inside surface of said sidewall when moved to said open position.

11. The parts washer of claim 9 including at least one bearing secured to said door adjacent said lower edge, said bearing being located in said channel for guiding said door in said channel as said door is opened and closed.

12. The parts washer of claim 11 wherein said bearing includes a wheel.

13. The parts washer of claim 12 wherein said wheel rotates about a generally vertical axis.

14. The parts washer of claim 9 wherein said channel defines a trough for catching some of the washer fluid being sprayed in said cabinet as said parts washer is being operated to form a liquid/fluid seal along said lower edge.

15. The parts washer of claim 14 wherein said flange includes a downwardly projecting leg, said downwardly projecting leg extending along said inner web into said interior space of said wash cabinet.

16. The parts washer as defined in claim 9 wherein said wash cabinet includes a top wall; said door being pivotally supported from said top wall.

* * * * *